US009468271B2

(12) United States Patent
Troy, Jr.

(10) Patent No.: US 9,468,271 B2
(45) Date of Patent: Oct. 18, 2016

(54) SUPPORTING DEVICES THAT INCLUDE CONVERTIBLE MECHANISMS

(71) Applicant: Paul Francis Troy, Jr., Worcester, MA (US)

(72) Inventor: Paul Francis Troy, Jr., Worcester, MA (US)

( * ) Notice: Subject to any disclaimer, the term of this patent is extended or adjusted under 35 U.S.C. 154(b) by 0 days.

(21) Appl. No.: 14/179,675

(22) Filed: Feb. 13, 2014

(65) Prior Publication Data

US 2015/0223577 A1 Aug. 13, 2015

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01); *A61H 2201/1635* (2013.01)

(58) Field of Classification Search
CPC ..... A45B 9/04; A61H 2003/0272; A61H 3/0288
USPC ..... 135/78, 80
See application file for complete search history.

(56) References Cited

U.S. PATENT DOCUMENTS

| | | | | |
|---|---|---|---|---|
| 1,031,247 | A * | 7/1912 | Conrad | 135/80 |
| 1,709,686 | A * | 4/1929 | Ryan | 135/80 |
| 2,376,776 | A * | 5/1945 | Jones et al. | 135/79 |
| 2,517,203 | A * | 8/1950 | Hansen | 135/80 |
| 3,170,475 | A * | 2/1965 | Forbes | 135/80 |
| 3,273,575 | A * | 9/1966 | Aldrich | 135/77 |
| 4,299,246 | A | 11/1981 | Marsh | |
| 4,434,808 | A * | 3/1984 | Burak | 135/80 |
| 5,103,850 | A | 4/1992 | Davis | |
| 5,377,710 | A * | 1/1995 | Laser | A61H 3/0288 135/66 |
| 5,385,163 | A * | 1/1995 | Fairchild | 135/65 |
| 6,634,608 | B2 * | 10/2003 | Jacobowitz | 248/230.7 |
| 6,877,520 | B2 | 4/2005 | Morris | |
| D516,799 | S | 3/2006 | Gordon | |
| 7,360,548 | B1 | 4/2008 | Hinca | |
| D590,591 | S | 4/2009 | Yates | |

(Continued)

FOREIGN PATENT DOCUMENTS

| | | | |
|---|---|---|---|
| AT | 413787 B | * | 4/2006 |
| AU | 2007211942 | | 3/2009 |

(Continued)

OTHER PUBLICATIONS http://www.amazon.com/Rain-Guard-Non-Slip-Cane-Crutch-Tips/dp/B0083K1OQI/ref=sr_1_12?ie=UTF8&qid=1385082624&sr=8-12&keywords=crutches+accessories; downloaded Mar. 19, 2014; known at least as early as Nov. 21, 2013.

(Continued)

*Primary Examiner* — Noah Chandler Hawk
(74) *Attorney, Agent, or Firm* — Fish & Richardson P.C.

(57) ABSTRACT

A convertible supporting device includes a base, rotatable portion, and a rotation mechanism. The base is for a supporting device having a bottom surface. When exposed, the bottom surface of the supporting device is for contact with another surface to provide support for a user of the supporting device. The rotatable portion is coupled to the base and is rotatable relative to the base. The rotatable portion includes a work plate including an upper surface and a lower surface. The work plate defines through holes across a plate thickness between the upper surface and the lower surface. The rotatable portion also includes one or more elements, a portion of which is exposed beyond the lower surface of the work plate. The rotation mechanism connects the base and the rotatable portion.

41 Claims, 11 Drawing Sheets

(56) References Cited

U.S. PATENT DOCUMENTS

| | | | |
|---|---|---|---|
| 8,387,638 | B2 | 3/2013 | Schroeder et al. |
| 8,393,342 | B2 | 3/2013 | Goldberg et al. |
| D679,492 | S | 4/2013 | Pethoud |
| 8,418,704 | B1 | 4/2013 | Teeters |
| 8,428,788 | B2 | 4/2013 | Takenaka et al. |
| 2010/0313925 | A1 | 12/2010 | Jiang |

FOREIGN PATENT DOCUMENTS

| | | |
|---|---|---|
| CN | 2170666 | 7/1994 |
| CN | 2416777 | 1/2001 |
| CN | 2584173 | 11/2003 |
| CN | 2865382 | 2/2007 |
| CN | 201585521 | 9/2010 |
| CN | 201709582 | 1/2011 |
| CN | 201879979 | 6/2011 |
| CN | 202341047 | 7/2012 |
| CN | 202489342 | 10/2012 |
| CN | 202505701 | 10/2012 |
| CN | 202044477 | 11/2012 |
| DE | 102006009757 | 9/2007 |
| DE | 102008033492 | 5/2009 |
| DE | 102008011143 | 8/2009 |
| DE | 102008017907 | 10/2009 |
| DE | 102008019181 | 10/2009 |
| DE | 102008025847 | 12/2009 |
| EP | 2027790 | 4/2011 |
| GB | 2044610 | 10/1980 |
| GB | 2494906 | 3/2013 |
| JP | 9154902 | 6/1997 |
| JP | 2006158898 | 6/2006 |
| JP | 03163070 | 9/2010 |
| JP | 04675507 | 4/2011 |
| WO | WO 9800043 | 1/1998 |
| WO | WO 2004049855 | 6/2004 |

OTHER PUBLICATIONS http://www.amazon.com/Non-Slip-Crutch-Tips-RainGuards-Separately/dp/B0083K4QUE/ref=pd_sim_hpc_1 ; downloaded Mar. 19, 2014; known at least as early as Nov. 21, 2013.

http://www.amazon.com/The-SandPad-Beach-Crutch-Tips/dp/B006JWPL3O/ref=sr_1_1?ie=UTF8&qid=1385082761&sr=8-1&keywords=crutches+sand; downloaded Mar. 19, 2014; known at least as early as Nov. 21, 2013.

http://www.amazon.com/Retractable-Snow-Spike-Canes-Crutches/dp/B002W7CZ3Y/ref=sr_1_6?ie=UTF8&qid=1385082738&sr=8-6&keywords=crutches+snow; downloaded Mar. 19, 2014; known at least as early as Nov. 21, 2013.

http://www.amazon.com/Cane-Ice-Tip-Attachment-1087/dp/B0009STN2E/ref=sr_1_3?ie=UTF8&qid=1385082736&sr=8-3&keywords=crutches+snow; downloaded Mar. 19, 2014; known at least as early as Nov. 21, 2013.

http://www.amazon.com/Fetterman-Ice-Grip-Tips-Crutches/dp/B005ERUQQW/ref=sr_1_10?ie=UTF8&qid=1385082738&sr=8-10&keywords=crutches+sno; downloaded Mar. 19, 2014; known at least as early as Nov. 21, 2013.

* cited by examiner

SUPPORTING DEVICES THAT INCLUDE CONVERTIBLE MECHANISMS

TECHNICAL FIELD

This disclosure relates to supporting devices that include convertible mechanisms. The supporting devices can be, e.g., crutches or canes.

BACKGROUND

Supporting devices are provided to people, such as those with injuries or disabilities, or those who are senior, to provide stability and help with balancing and moving. Examples of supporting devices include crutches and canes of various forms. For example, a supporting device can include an upper part that can be held by a person, e.g., using hand(s) or under an armpit, and a lower part that has a bottom portion in contact with a supporting surface, e.g., a floor or land. At least part of the person's weight can be supported by the supporting device through the contact of the bottom portion with the supporting surface.

SUMMARY

In one aspect, the disclosure features an apparatus comprising a base, rotatable portion, and a rotation mechanism. The base is for a supporting device having a bottom surface. When exposed, the bottom surface of the supporting device is for contact with another surface to provide support for a user of the supporting device. The rotatable portion is coupled to the base and is rotatable relative to the base. The rotatable portion comprises a work plate comprising an upper surface and a lower surface. The work plate defines through holes across a plate thickness between the upper surface and the lower surface. The rotatable portion also comprises one or more elements, a portion of which is exposed beyond the lower surface of the work plate. The rotation mechanism connects the base and the rotatable portion. The rotation mechanism comprises a locking mechanism providing a first bias force to hold the work plate in a first position and a second bias force to hold the work plate in a second position. The work plate has the first position with the bottom surface of the supporting device exposed, and the second position with the bottom surface of the supporting device covered by the work plate and the lower surface of the work plate is exposed to be in contact with the other surface to provide support for a user of the supporting device.

In another aspect, the disclosure features a supporting device comprising a pole, a bottom surface in contact with another surface to provide support for a user of the supporting device, and a convertible mechanism. The convertible mechanism comprises a base mounted on the pole, a rotatable portion coupled to the base and rotatable relative to the base, and a rotation mechanism connecting the base and the rotatable portion. The rotatable portion comprises a work plate that comprises an upper surface and a lower surface. The work plate defines through holes across a plate thickness between the upper surface and the lower surface. The rotatable portion also comprises one or more elements, a portion of which is exposed beyond the lower surface of the work plate. The rotation mechanism comprises a locking mechanism to provide a first bias force holding the work plate in a first position and a second bias force holding the work plate in a second position. In the first position, the bottom surface is exposed, and in the second position, the bottom surface of the supporting device is covered by the work plate and the lower surface of the work plate is exposed for contact with the other surface to provide support for a user of the supporting device.

In another aspect, the disclosure features an apparatus comprising a base structure for mounting on a supporting device having a bottom surface. The base structure comprises a work plate and one or more elements. The work plate defines an upper surface and a lower surface, and the work plate defines through holes across a plate of thickness between the upper surface and the lower surface. When the base structure is mounted to the supporting device, the work plate covers the bottom surface of the supporting device and the lower surface of the work plate contacts another surface to provide support for a user of the supporting device. Portions of the one or more elements are exposed beyond the lower surface of the work plate. The apparatus also includes a rotatable plate attached to the base structure and rotatable relative to the base structure between a first position and a second position. The rotatable plate defines an upper surface and a lower surface. The base structure, in the first position, mounted on the supporting device, has its lower surface of the work plate exposed to contact the other surface, and in the second position, has its lower surface of the work plate covered by the rotatable plate so that the lower surface of the rotatable plate contacts the other surface to provide support for the user of the supporting device.

In another aspect, the disclosure features a supporting device comprising a pole, a base structure mounted on the pole, and a rotatable plate attached to the base structure and rotatable relative to the base structure between a first position and a second position. The base structure comprises a work plate and one or more elements. The work plate defines an upper surface and a lower surface. The work plate defines through holes across a plate thickness between the upper surface and the lower surface. The lower surface of the work plate is positioned to contact another surface to provide support for a user of the supporting device. Portions of the one or more elements extend through the plate thickness and beyond the lower surface of the work plate. The rotatable plate defines an upper surface and a lower surface. In the first position, the lower surface of the work plate is exposed for contact with the other surface, and in the second position, the lower surface of the work plate is covered by the rotatable plate and the lower surface of the rotatable plate is disposed contact with the other surface to provide support for the user of the supporting device.

In another aspect, the disclosure features an apparatus comprising a support device configured to provide support on a surface. The support device comprises a support member that has a first surface engaging member, a convertible surface engaging device coupled to the support member, a linkage mechanism having pivotable link members, and a bias mechanism. The convertible surface engaging device has a second surface engaging member movable between a first position and a second position relative to the support member. When the second surface engaging member is in the first position, the second surface engaging member is positioned below the first surface engaging member. When the second surface engaging member is in the second position, the second surface engaging member is positioned above the first ground engaging surface. The linkage mechanism having pivotable link members enables the second surface engaging member to move between the first and second positions. The bias mechanism provides a first bias force to maintain the second surface engaging member in the first position after the second surface engaging member has moved to the first position, and provides a second bias force to maintain the second surface engaging member in the second position after the second surface engaging member has moved to the second position.

The embodiments of the aspects may also include one or more of the following features. The lower surface of the work plate has a larger surface area than the bottom surface of the supporting device. The lower surface of the work plate is round and has a diameter of about 3 inches to 7 inches. The one or more elements comprise one or more screws. The portion of the one or more elements exposed beyond the lower surface of the work plate is sharp so that in use, the portion exposed penetrates an opposed hard surface to provide stability. The locking mechanism comprises a spring. The work plate comprises polycarbonate. The upper and lower surfaces of the work plate define openings corresponding to the through holes, the openings occupying about 20% to about 45% of surface areas of the upper and lower surfaces. The base defines a hollow center through which a portion of the supporting device passes when the base is mounted to the supporting device. The lower surface of the work plate defines protrusions. The lower surface of the work plate is roughened.

The embodiments of the aspects may also include one or more of the following features. The pole is part of a cane, a crutch, a walker, or a walking stick. The lower surface of the work plate is spaced from direct contact with the upper surface of the rotatable plate. The lower surface of the work plate has a surface area the same or smaller than the upper surface of the rotatable plate. The lower surface of the rotatable plate is smooth. The rotatable plate comprises rubber.

The embodiments of the aspects may also include one or more of the following features. The bias mechanism enables a user to move the second surface engaging member from the first position to the second position by applying a force greater than the first bias force, and to move the second surface engaging member from the second position to the first position by applying a force greater than the second bias force. The second surface engaging member has a larger surface area compared to the first surface engaging member. The first surface engaging member is configured for use when walking on a dry surface, and the second surface engaging member is configured for use when walking on at least one of a wet, a snowy, an icy, or a sandy surface. The first bias force is greater than the second bias force. The first surface engaging member comprises a rubber tip. The second surface engaging member comprises a disk. The second surface engaging member comprises projections extending downward from the disk when the second surface engaging member is in the first position. The disk comprises perforations. The bias mechanism comprises a spring that provides the first or second bias force. The first bias force has a component that pulls the second surface engagement member upwards such that when the second surface engagement member is in the second position, a downward force needs to be applied to a portion of the second surface engagement member in order to move the second surface engagement member away from the second position.

Other features, objects, and advantages of the invention will be apparent from the description and drawings, and from the claims.

DETAILED DESCRIPTION

This description relates in general to a convertible supporting device, such as a crutch, a cane, a walker, or a walking stick, that can be used on a variety of surface conditions, such as hard floor or ground covered with ice, sand, or snow. In some implementations, the convertible supporting device has a first supporting member for use when the user is walking on a relatively hard surface (such as wood or concrete floor), and a second supporting member for use when the user is walking on a relatively soft surface (such as ground covered with ice, sand, or snow). The second supporting member has a larger surface area than that of the first supporting member to prevent (or reduce the amount of) sinking in the relatively soft surface.

In some implementations, the second supporting member pivots or rotates between a first position and a second position. In the first position, the second supporting member is positioned higher (relative to ground surface) than the first supporting member so that only the first supporting member engages the ground surface. In the second position, the second supporting member is positioned lower than the first supporting member so that the second supporting member engages the ground surface. A bias mechanism is provided to provide a bias force to maintain the second supporting member in the first or second position while still allowing the user to easily move the second supporting member between the first and second positions.

Figure 1:
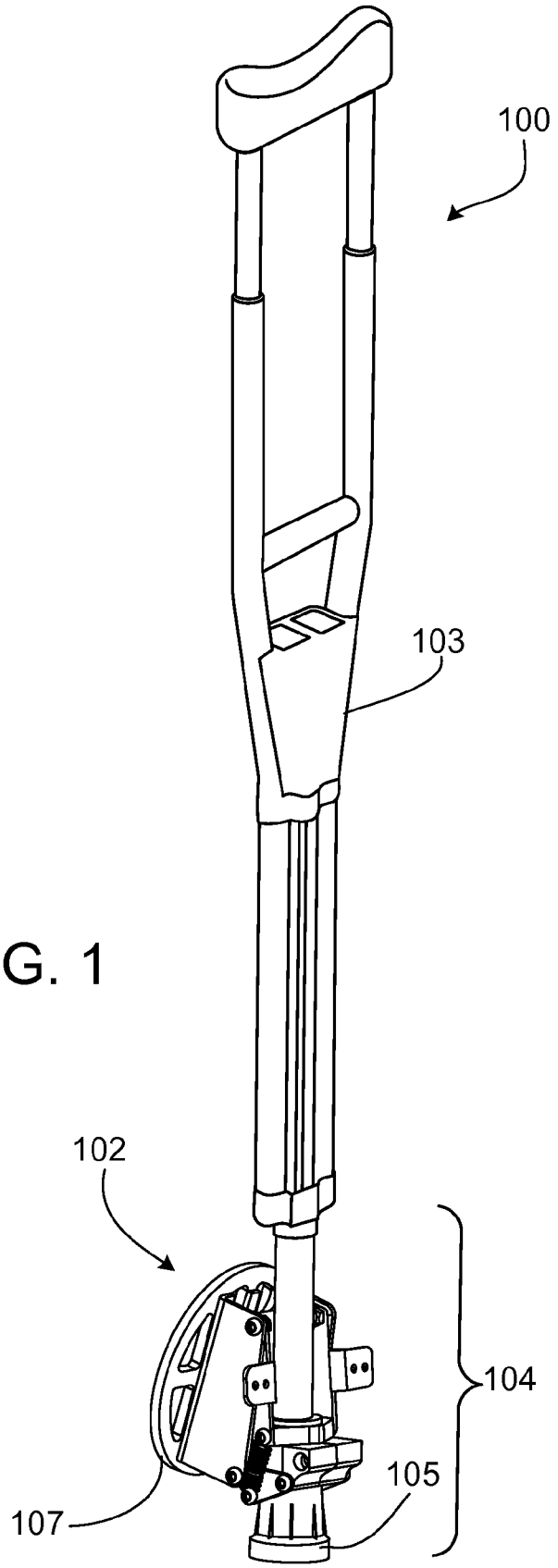
FIG. 1 is a schematic perspective view of a crutch on which a convertible mechanism is mounted.

Referring to FIG. 1, a supporting device 100 includes a supporting member 103 and a convertible surface engaging device 102 attached, e.g., fastened or secured, to a lower portion 104 of the supporting member 103. In the example of FIG. 1, the supporting member 103 is a crutch. The crutch can be, e.g., a conventional crutch. The lower portion 104 has a first surface engaging member 105 that engages the ground surface when the user uses the supporting device 100 to walk on a relatively hard surface. The convertible surface engaging device 102 has a second surface engaging member

108 that engages the ground surface when the user uses the supporting device 100 to walk on a relatively soft surface. The second surface engaging member 108 has a larger surface area than that of the first surface engaging member 105.

Figure 2:
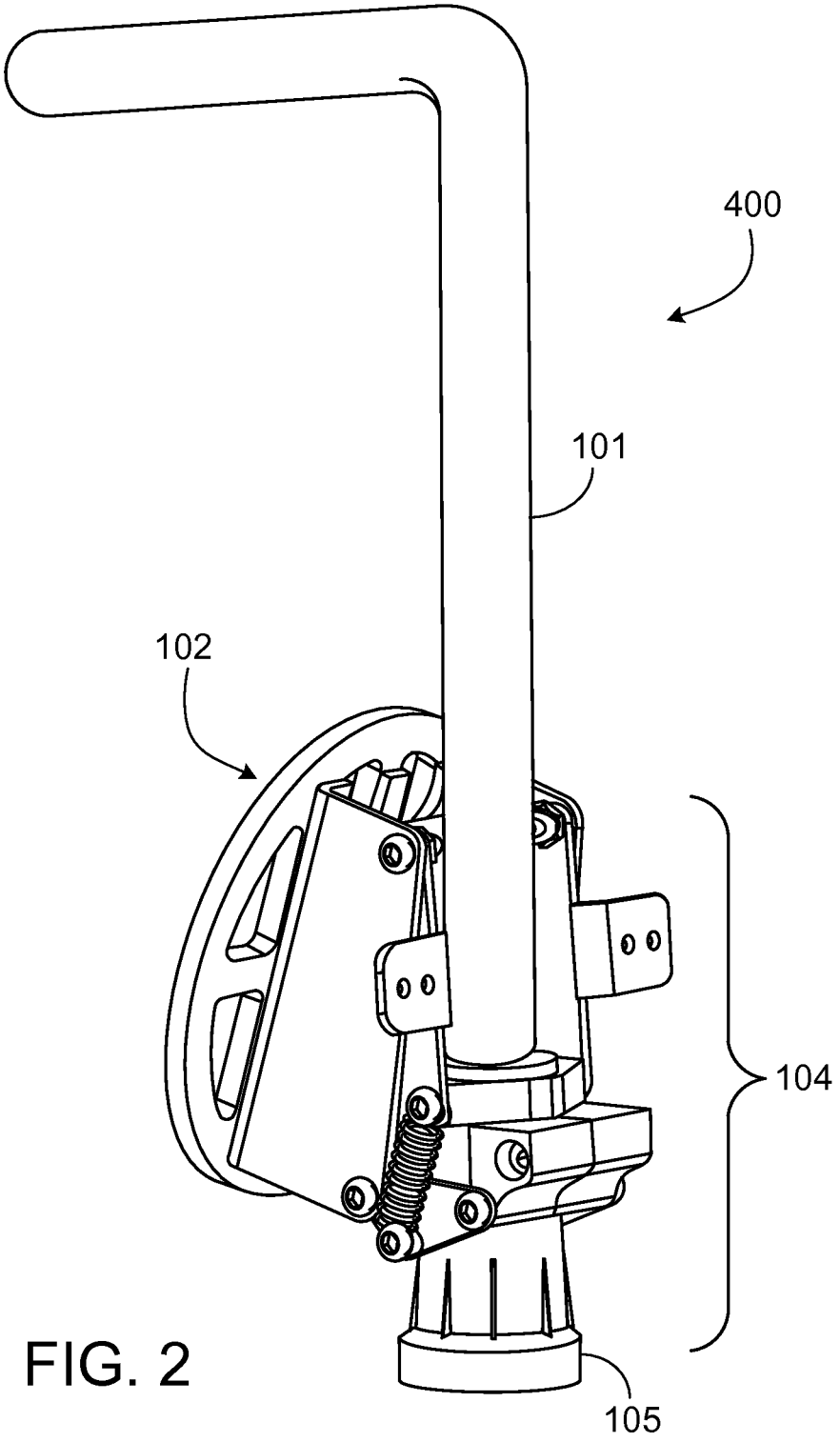
FIG. 2 is a schematic perspective view of a cane on which a convertible mechanism is mounted.

Referring to FIG. 2, a supporting device 400 includes a supporting member 101 and a convertible surface engaging device 102 attached, e.g., fastened or secured, to a lower portion 104 of the supporting member 101. In the example of FIG. 2, the supporting member 101 is a cane. The cane can be, e.g., a conventional cane. The convertible surface engaging device 102 can be attached to other types of supporting members and is not limited to being used with crutches or canes.

Figure 3B:
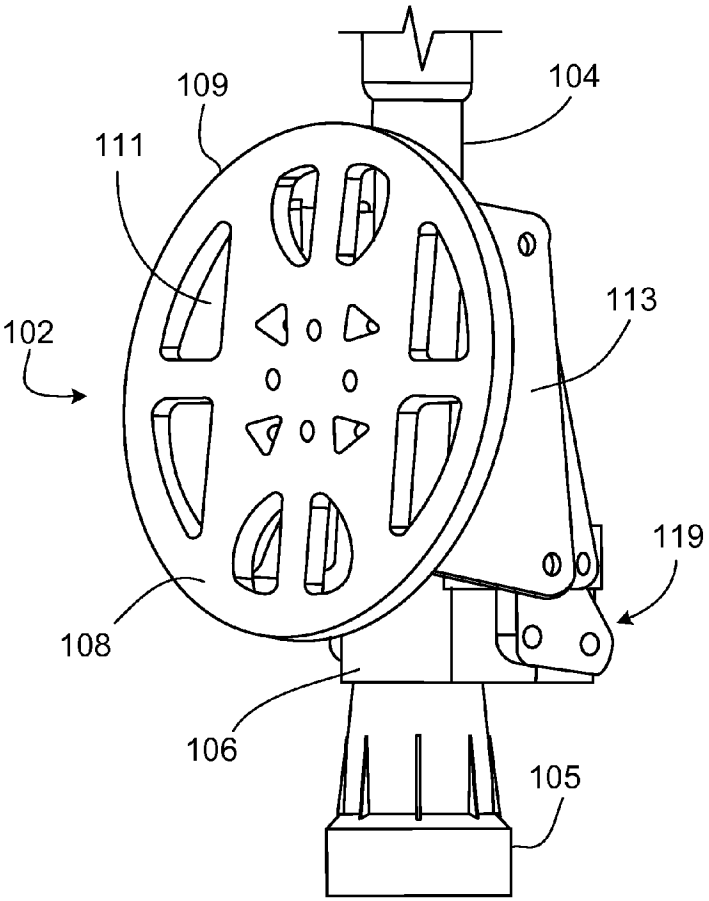
FIGS. 3A and 3B are schematic side view and schematic perspective view of a portion of an example supporting device in which a convertible mechanism of the supporting device is in a resting position.
Figure 3A:
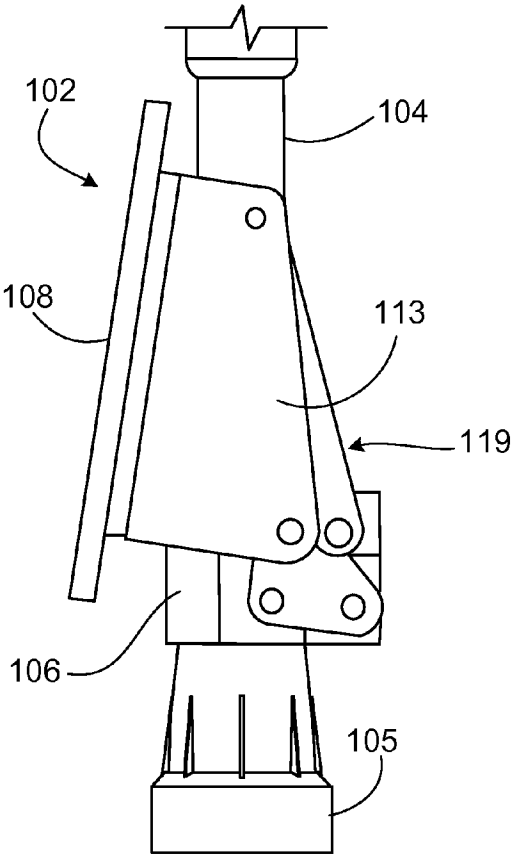

Referring to FIGS. 3A to 3D, the convertible surface engaging device 102 can switch between a resting configuration and a working configuration. FIGS. 3A and 3B show a side view and a perspective view, respectively, of the convertible surface engaging device 102 in the resting configuration. In the resting configuration, the surface engaging member 108 is positioned higher than the surface engaging member 105 relative to the ground, so the surface engaging member 105 engages the ground surface. For example, the surface engaging member 105 can be made of rubber, plastic, wood, or metal, and the bottom surface of the surface engaging member 105 can be flat and smooth. The shape of the bottom surface can be round, rectangular, or other shapes.

Figure 3D:
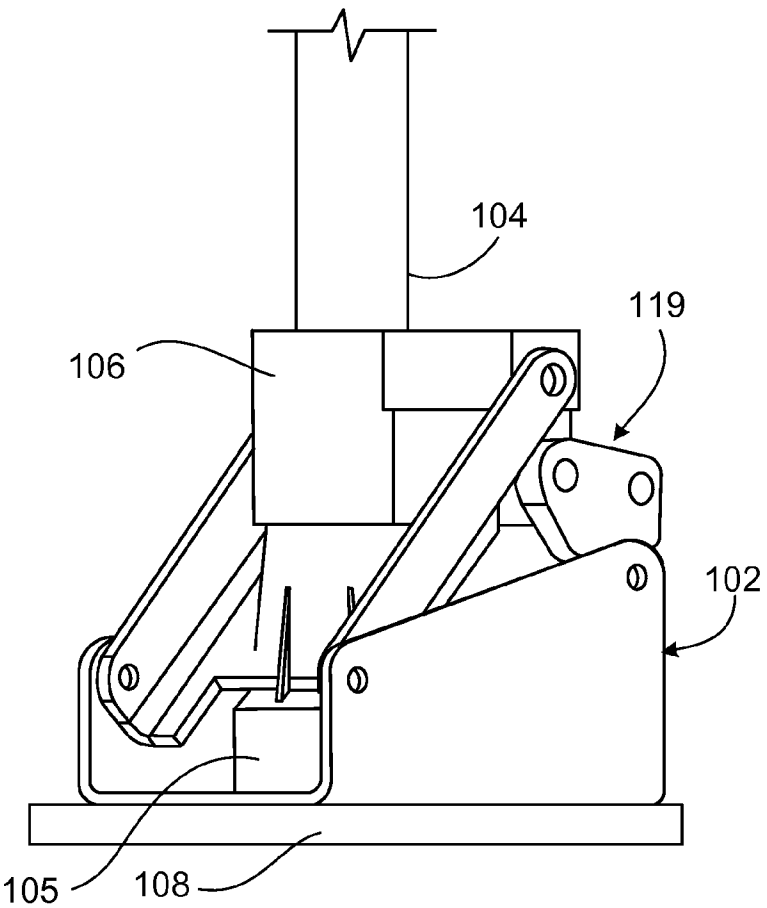
FIGS. 3C and 3D are schematic side view and schematic perspective view of a portion of an example supporting device in which a convertible mechanism of the supporting device is in a working position.
Figure 3C:
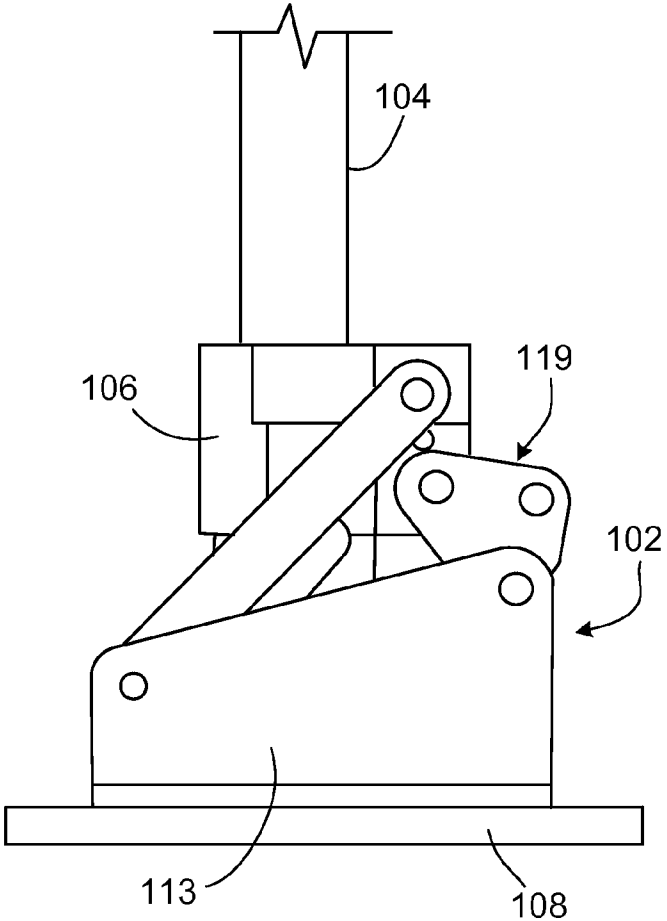

FIGS. 3C and 3D show a side view and a perspective view, respectively, of the convertible surface engaging device 102 in the working configuration. In the working configuration, the surface engaging member 108 is positioned lower than the surface engaging member 105 relative to the ground, so the surface engaging member 108 engages the ground surface. For example, the surface engaging member 108 can have a large surface area to support the weight of the supporting device 100 and a portion of the weight of the user on soft ground surfaces, such as on ground covered with ice, sand, or snow. The surface engaging member 108 can have several shapes and configurations. In the example shown in FIG. 3B, the surface engaging member 108 includes a circular plate 109 having several openings 111. The surface engaging member 108 can have studs or other protrusions to enhance ground gripping capability. The surface engaging member 108 can have other shapes, such as rectangular or hexagonal shapes.

As shown in FIGS. 3A to 3D, the convertible surface engaging device 102 includes a bracket support 113 that is connected to the surface engaging member 108. The convertible surface engaging device 102 includes a base 106 that is attached to the lower portion 104 of the support member 103. The base 106 is coupled to the bracket support 113 through a linkage mechanism 119 that includes several link members that rotate about pivot points.

Figure 4B:
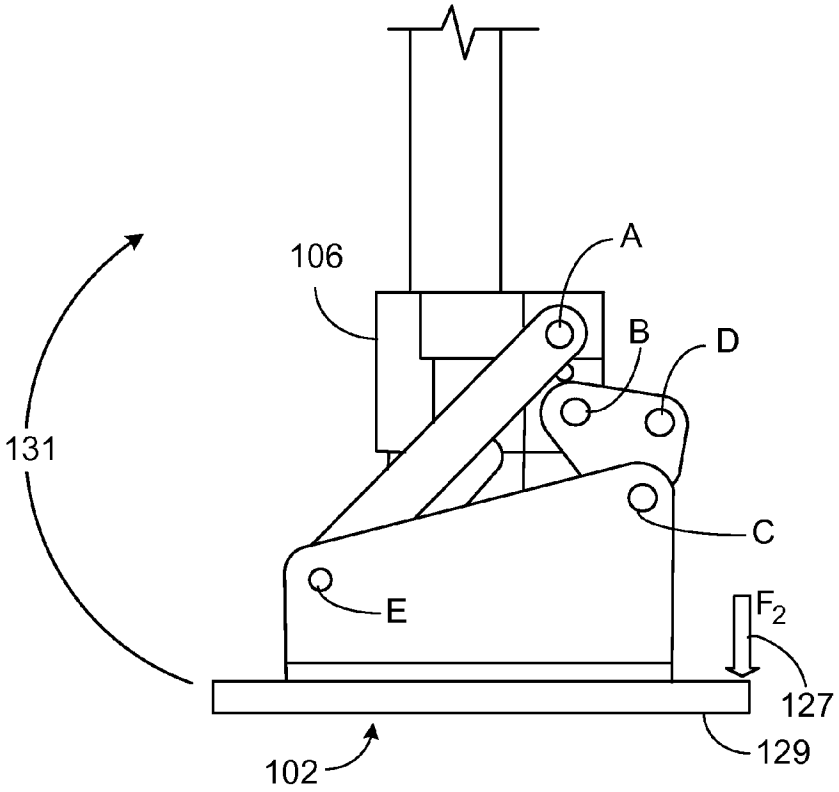
FIGS. 4A and 4B are schematic side views of a portion of an example supporting device in which a convertible mechanism of the supporting device is in a resting position and a working position, respectively, illustrating conversion between the resting position and the working position.
Figure 4A:
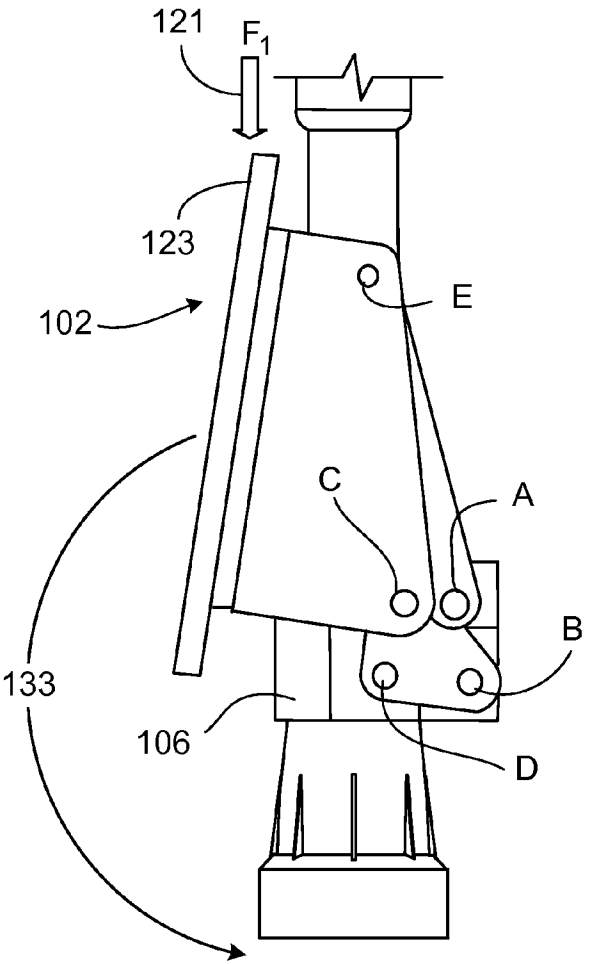

Referring to FIG. 4A, when the user intends to switch the convertible surface engaging device 102 from the resting position to the working position, the user can apply a force F1 along a direction 121 to a portion 123 of the surface engaging member 108 to push the surface engaging member 108 and the bracket support 113 downwards, and eventually swing the surface engaging member 108 and the bracket support 113 along direction 133 from an upper position to a lower position. The link members rotate about stationary pivots A and B (stationary relative to the base 106), and movable pivots C, D, and E (movable relative to the base 106).

Referring to FIG. 4B, in some implementations, when the user intends to switch the convertible surface engaging device 102 from the working position to the resting position, the user can apply a force F2 along a direction 127 to a portion 129 of the surface engaging member 108 to push the surface engaging member 108 and the bracket support 113 downwards and then sideways, and eventually swing the surface engaging member 108 and the bracket support 113 from the lower position to the upper position.

A bias mechanism, such as springs (not shown in FIGS. 3A to 3D, 4A, and 4B), provides a bias force to maintain the surface engaging device 102 in the resting or working configuration. As described in more detail below, the linkage mechanism 119 and the bias mechanism are designed such that in the resting configuration, the bias force is strong enough to maintain the surface engaging member 108 and the bracket support 113 in the upper position, but not too strong so as to make it difficult for the user to switch the surface engaging device 102 to the working position.

Under normal usage, as the user walks on a ground surface with the assistance of the supporting device 100, frictional force will be applied to the surface engaging member 108 along a direction substantially parallel to the ground surface. The linkage mechanism 119 and the bias mechanism are designed such that the bias force from the bias mechanism is strong enough to counteract the frictional force and maintain the surface engaging member 108 and the bracket support 113 in the lower position, but not too strong so as to make it difficult for the user to switch the surface engaging device 102 to the resting position.

Figure 5A:
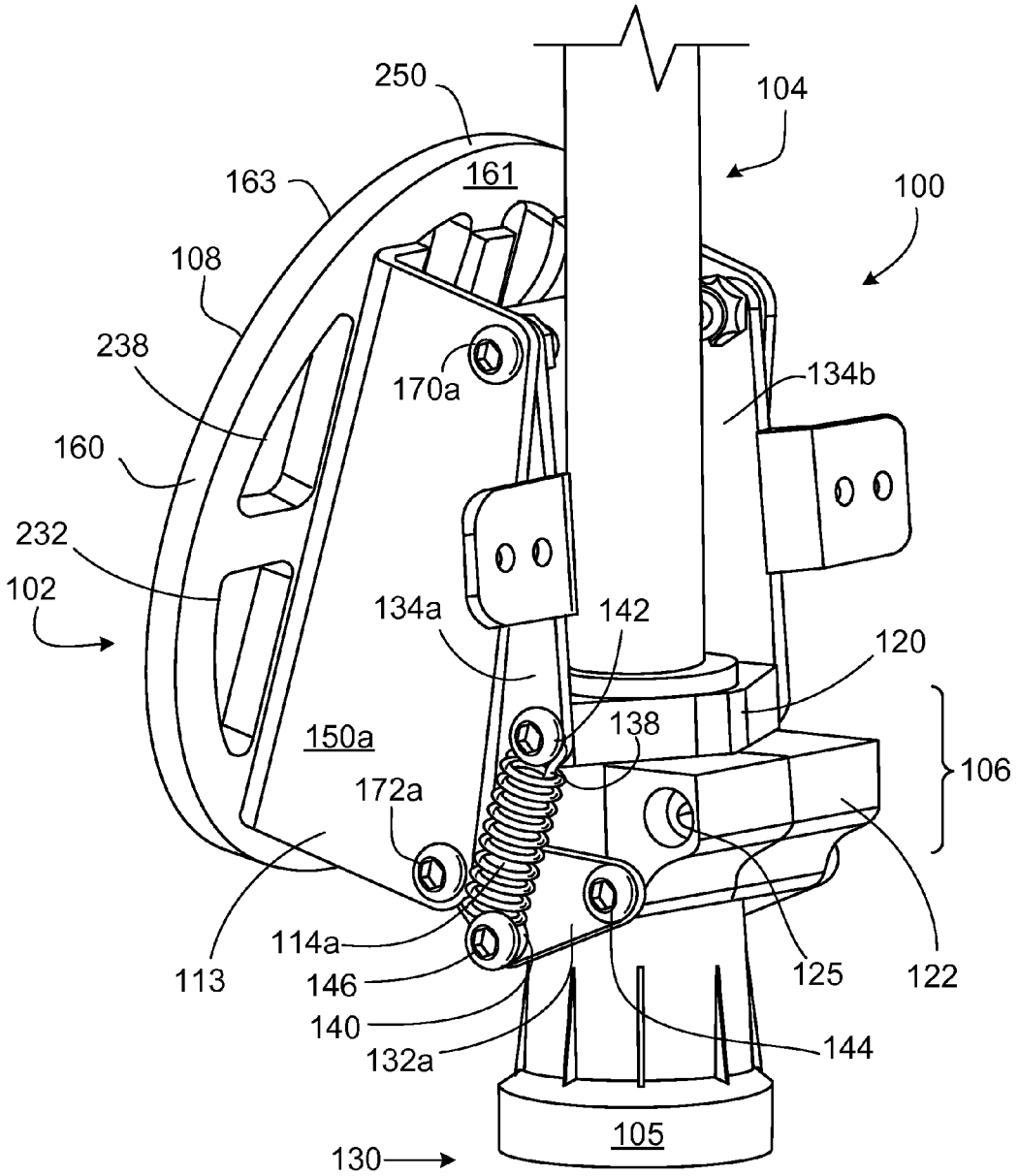
FIGS. 5A and 5B are schematic perspective views of a portion of an example supporting device in which a convertible mechanism of the supporting device is in a resting position and a working position, respectively.
Figure 5B:
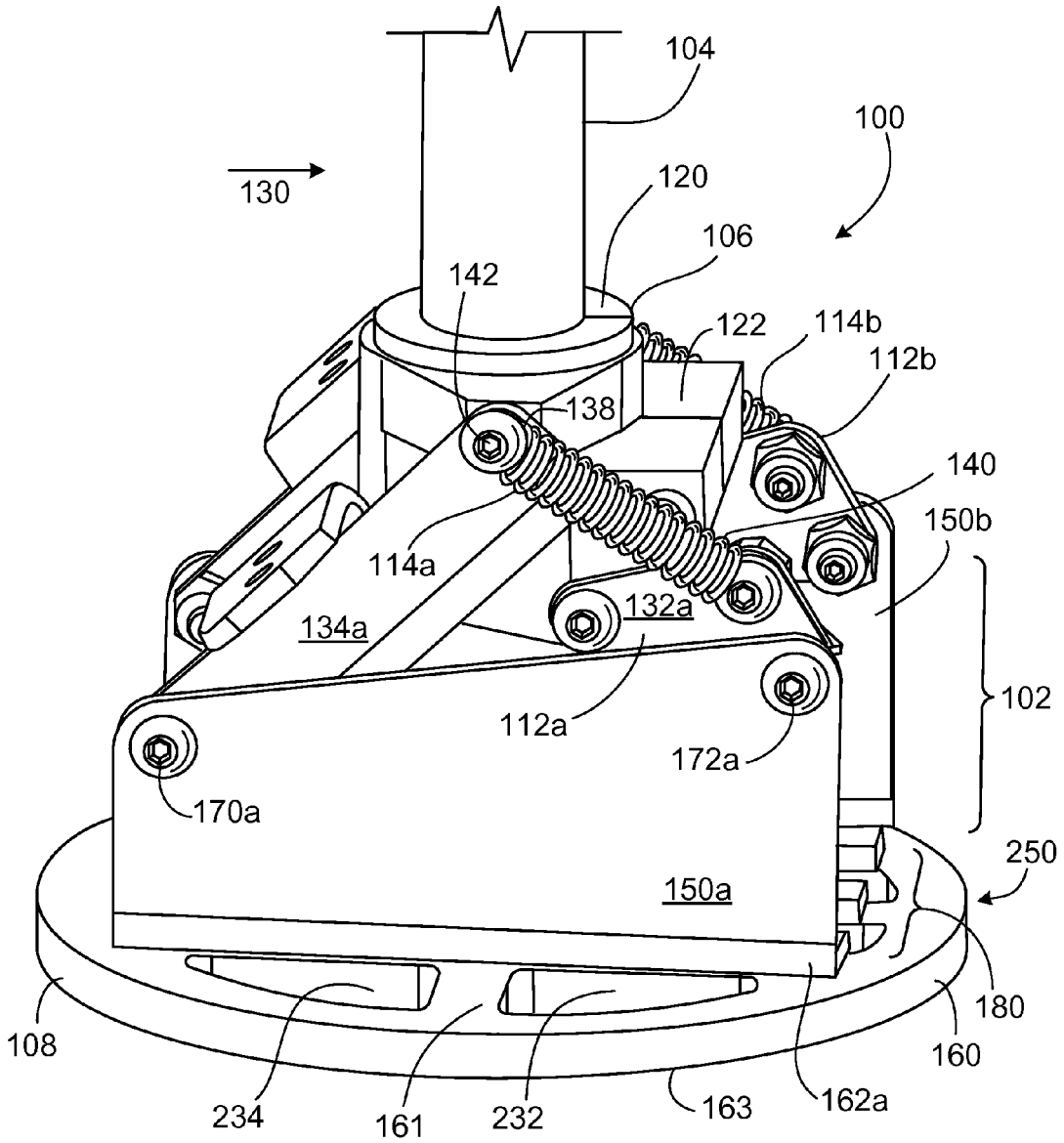

Referring to FIGS. 5A and 5B, the base 106 is stationary relative to the lower portion 104 of the supporting member (e.g., 101 or 103), whereas the surface engaging member 107 moves relative to the stationary base 106 between the resting position (as shown in FIG. 5A) and the working position (as shown in FIG. 5B). The stationary base 106 is supported by the bracket support 113, which for example can have a general U-shape having two side support members 150*a* and 150*b*.

The stationary base 106 is connected to the bracket support 113 through the linkage mechanism 119. For example, the linkage mechanism 119 can have a first set of links 112*a* that connect the first side support member 150*a* to a first portion of the base 106, and a second set of links 112*b* that connect the second side support member 150*b* to a second portion of the base 106. The first set of links 112*a* includes a first link member 132*a* and a second link member 134*a*. The second set of links 112*b* includes a first link member 132*b* and a second link member 134*b*. Each of the link members 132*a*, 132*b*, 134*a*, and 134*b* can be, e.g., a plate having a shape to allow screws to be mounted to form pivots at the proper locations. The structure and function of the first and second sets of links 112*a*, 112*b* can be similar or identical. The description of the structure and function of the first set of links 112*a* is also applicable to the second set of links 112*b*.

Figure 6:
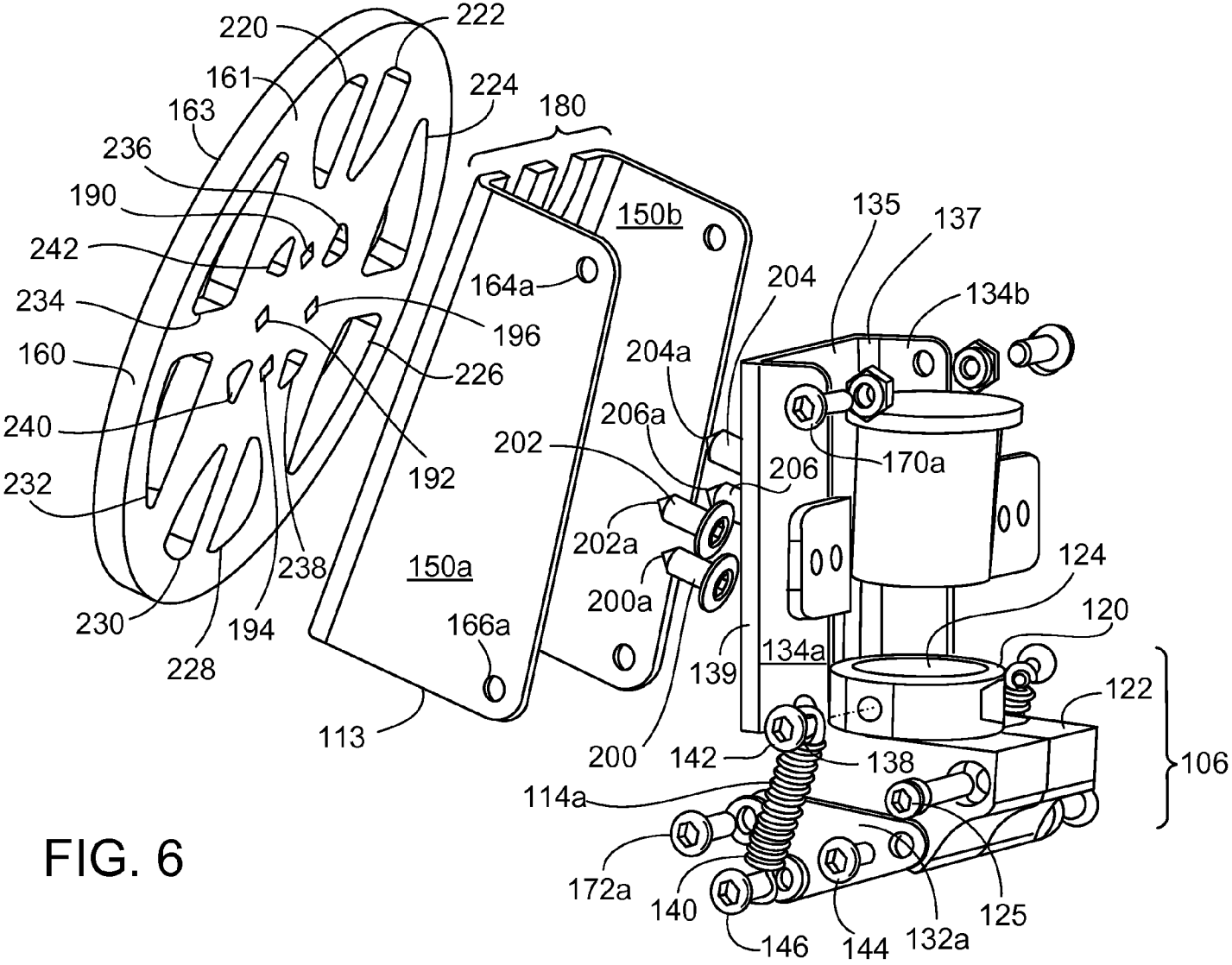
FIG. 6 is an exploded view of an example convertible mechanism of FIGS. 5A and 5B.

Referring also to FIG. 6, the stationary base 106 includes a collar insert or split ring 120 in the form of a flexible ring with an axially extending opening. The inner wall of the split ring 120 generally defines an opening 124 having a shape that corresponds to the cross-sectional shape of the lower portion 104 of the supporting member (e.g., 101 or 103). A wrap around attachment device 122 wraps around the split ring 120 such that when the attachment device 122 is tightened, e.g., by using a screw 125, the attachment device 122 tightly wraps around the split ring 120, which in turn tightly wraps around the lower portion 104 of the supporting member. This way, the base 106 is firmly attached to the lower portion 104 of the supporting member and does not move relative to the lower portion 104 when the supporting device 100 is in use.

The split ring 120 and the attachment device 122 can accommodate a variety of cross-sectional sizes and shapes for the lower portion 104 of the supporting device. The split ring 120 and the attachment device 122 can be loosened to allow the base 106 to be removed from the lower portion 104 of the supporting member.

In some implementations, the first set of links 112*a* includes the link members 132*a*, 134*a*. The link member 132*a* is rotatably coupled to the base 106 by using a screw 144, such that the link member 132*a* can rotate about the long axis of the screw 144. The link member 132*a* is rotatably coupled to the side support member 105*a* by using a screw 172*a*, which forms a movable pivot that moves as the surface engaging device 102 switches between the resting and working configurations.

The link member 134*a* is rotatably coupled to the base 106 by using a screw 142, such that the link member 134*a* can rotate about the long axis of the screw 142. The link member 134*a* is rotatably coupled to the side support member 150*a* by using a screw 170*a*, which forms a movable pivot that moves as the surface engaging device 102 switches between the resting and working configurations.

A spring 114*a* has one end 138 attached to the link member 134*a* using the screw 142, and another end 140 attached to the link member 132*a* using a screw 146. As shown in FIG. 5A, when the convertible surface engaging device 102 is in the resting position, the spring 114*a* provides a bias force that pulls the movable pivot defined by the screw 146 toward the stationary pivot defined by the screw 142. The bias force maintains the surface engaging member 108 and the bracket support 113 in the upper position. As shown in FIG. 5B, when the convertible surface engaging device 102 is in the working position, the spring 114*a* provides a bias force that pulls the movable pivot defined by the screw 146 toward the stationary pivot defined by the screw 142. The bias force maintains the surface engaging member 108 and the bracket support 113 in the lower position.

In some implementations, the second set of links 112*b* includes the link members 132*b*, 134*b* that are connected to the base 106, the second side support member 150*b*, and a spring 114*b* in a way similar to the first set of links 112*a*.

In some implementations, the link members 134*a*, 134*b* are connected by or formed integrally with a connection plate 135 so that the link members 134*a*, 134*b* move together. The connection plate 135 connects the link members 134*a*, 134*b* along long edges 137, 139 such that the connection plate 135 and the link members 134*a*, 134*b* define a space to accommodate the lower portion 104 when the convertible surface engaging device 102 is in the resting configuration.

Referring to FIG. 6, the side support member 150*a* has a screw hole 164*a* that allows the screw 170*a* to pass, such that the side support member 150*a* can be rotatably coupled to the link member 134*a*. The side support member 150*a* has a screw hole 166*a* that allows the screw 172*a* to pass, such that the side support member 150*a* can be rotatably coupled to the link member 132*a*. In some examples, the two side support members 150*a*, 150*b* are identical. The description of the functions and configurations of the side support member 150*a* is also applicable to the side support member 150*b*.

In the example shown in FIGS. 5A, 5B, and 6, the bracket support 113 is a U-shaped integral part that includes the side support members 150*a*, 150*b* connected by a connecting plate 180. When the surface engaging device 102 is in the resting position, the U-shaped bracket support 113 defines a space that accommodates at least part of the connecting plate 135 and link members 134*a*, 134*b*. When the surface engaging device 102 is in the working position, the U-shaped bracket support 113 defines a space that accommodates a portion of the stationary base 106 and the lower portion 104. The surface engaging member 108 "covers" the surface engaging member 105 so that the surface engaging member 105 does not contact the ground surface.

The surface engaging member 108 can be, for example, a work plate 160 that has the shape of a flat disk with an upper surface 161 and a lower surface 163. The work plate 160 can have a circular shape with a diameter of, e.g., about 3 inches to 7 inches, e.g., 5 inches, and can have a thickness of, e.g., about 0.0625 inch to about 0.75 inch, e.g., about 0.25 inch. The work plate 160 can also have other shapes, such as an oval shape. The work plate 160 is attached to the connecting plate 135 of the bracket support 113 and can move (along with the bracket support 113) between the resting position and the working position.

In the resting position of FIG. 5A, the convertible surface engaging device 102 does not affect the functions of the first surface engaging member 105 of the supporting member 103. In the working position of FIG. 5B, the plate 160 is positioned below the surface engaging member 105 of the supporting member 103 and takes over the functions of the first surface engaging member 105. The plate 160 has a larger surface area than the first surface engaging member 105 and can provide better stability.

In the example shown in FIG. 6, the work plate 160 includes screw holes 190, 192, 194, and 196 that respectively match attachment mechanisms, such as screw holes, on the connecting plate 180. Screws 200, 202, 204, 206 can be used to attach the upper surface 161 of the plate 160 to the connecting plate 180.

Figure 7:
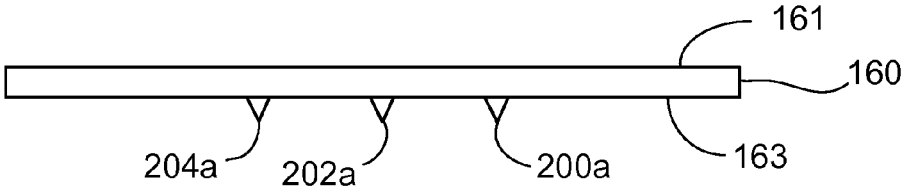
FIG. 7 is a schematic side view of an example work plate.

Referring to FIG. 7, in some implementations, each of the screws 200, 202, 204, 206 has an extended tip 200*a*, 202*a*, 204*a*, 206*a*, respectively, such that when the plate 160 is attached to the connecting plate 180, at least a portion of each extended tip extends beyond the lower surface 163 of the work plate 160. The extended tips 200*a*, 202*a*, 204*a*, 206*a* can each have a sharp end to penetrate a hard surface, such as ice. In addition, although not shown in the figures, optionally, the surface 163 of the plate 160 can be roughened or can contain protrusions similar to the extended tips of the screws or protrusions in other forms. The extended tips and protrusions can extend beyond the surface 163 by about 0.0625 inch to about 0.5 inch, e.g., 0.25 inch. The extended tips, protrusions, and/or roughened surface can allow the supporting device 100 to provide additional stability to the user when the user is on a slippery surface, e.g., on ice, by penetrating into the slippery surface and increasing the frictional force between the lower surface 163 of the plate 160 and the slippery surface. The number, pattern, and shapes of the extended tips and protrusions can be chosen based on the need of the supporting device. For example, although four screw holes and four screws are used in this example, any number of screw holes and screws can be used.

In addition to the screw holes, several openings, or through holes, are formed in the work plate 160. In the example shown in FIG. 6, twelve through holes 220 to 242 are formed in the work plate 160. In some implementations, the openings occupy about 15% to about 40%, e.g., about 26.5%, of the areas of surfaces 161 and 163. In the working position, the work plate 160 is pressed against a surface to provide support to the user. Some of the materials in the surface may extend beyond the surface 163 into the through holes, which may provide stability to the support. For example, when the surface is a slippery surface, such as ice, the penetration of the surface material, which can be a softer layer of the ice or other materials, can increase the friction force between the surface 163 and the slippery surface and can allow the extended tips and protrusions of the work plate 160 to penetrate a harder layer of the ice. When the surface is a soft surface, such as sand or snow, the penetration of the surface material can allow the work plate 160 and the soft surface to temporarily interlock to provide stable support to a user.

In some implementations, the connecting plate 180 also contains through holes such that when the work plate 160 is attached to the connecting plate 180, the through holes of the connecting plate 180 match those of the work plate 160, and the through holes of the work plate 160 are not blocked by the connecting plate 180. The combined through holes in the work plate 160 and the connecting plate 180 can allow more material to extend beyond the surface 163 of the work plate 160 and provide more stability for the support of the user. However, the through holes have sizes and shapes selected so that the holes do not trap the material, such as sand, snow, or dirt. The features of the work plate 160 can remain effective without the interference of the unwanted material, and it is easy for the user to move the supporting device 100 from one spot of the surface to the next spot of the surface.

The convertible surface engaging device 102 can be manipulated by hand, e.g., by pulling or pushing any part of the work plate 160 or the bracket support 113 relative to the base 106. The plate 160 can also be switched between the resting position and the working position using a foot. For example, when the surface engaging device 102 is in the resting position of FIG. 5A, the user may use a foot to kick or push an end 250 of the work plate 160 away from the lower portion 104 to move the work plate 160 to the working position. When the surface engaging device 102 is in the working position of FIG. 5B, the user may kick or push the end 250 of the plate 160 downwards. As described above, once being pulled or pushed away from one of the resting and work positions, the work plate 160 rotates to the other one of the two positions because of the spring force applied by the springs 114*a*, 114*b*.

In some implementations, the convertible surface engaging device 102 is connected to a triggering mechanism (not shown) that extends to the upper portion of the supporting member 103 so that the user can change the position of the surface engaging member 108 using one or both hands through the triggering mechanism without the need to directly manipulate the surface engaging member 108. This allows the user to switch the configurations of the surface engaging device 102 while standing without reaching down to move the surface engaging member 108.

The convertible surface engaging device 102 can be placed in the working position or the resting position as needed. For example, when the supporting device 100 is used indoor, e.g., on a hardwood or ceramic tile surface, the convertible surface engaging device 102 is placed in the resting position so that the extended tips, the surface roughness, and the protrusions of the work plate 160 do not adversely affect the indoor floor. When the supporting device is used on ice, snow, or sand, the convertible surface engaging device 102 is placed in the working position so that the work plate 160 can provide stable support to a user.

In some implementations, portions of the convertible surface engaging device 102 can be made of a light weight, corrosion resistant material, e.g., aluminum, polycarbonate, titanium, or stainless steel, so that the convertible surface engaging device 102 does not adversely affect operation of the supporting member 103. Each part of the convertible surface engaging device 102, including the base 106, the surface engaging member 108, the bracket support 113, and the linkage mechanism s 119, may be made of material(s) that provide the desired features, such as strength and durability, while is selected to be light in weight. For example, the base 106 may be formed of aluminum for its light weight, affordability, and strength. The screws may be stainless steel so that they resist corrosion. The plates 132*a*, 132*b*, 134*a*, 134*b*, 135 may be formed of aluminum or stainless steel. The intermediate plates 150*a*, 150*b* and the connection plate 180 may be formed of aluminum or stainless steel. The work plate 160 may be plastic, e.g., made of polyurethane or polycarbonate to provide the work plate with good impact resistance and durability. Other materials can also be used for the various parts.

Figure 8A:
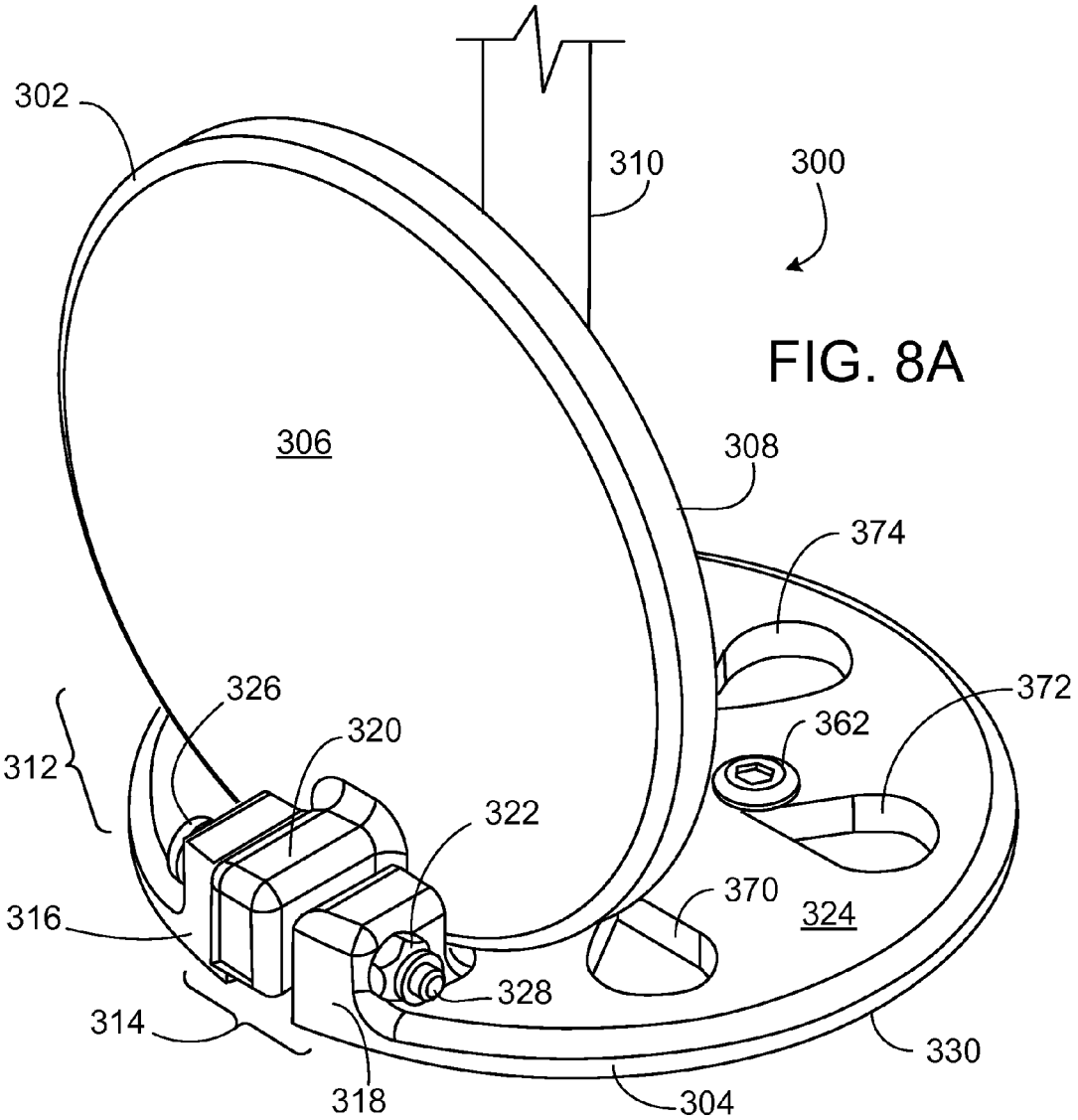
FIGS. 8A and 8B are schematic perspective views of a portion of another example of a supporting device in which a convertible mechanism of the supporting device is in an exposing position and a covering position, respectively.
Figure 8B:
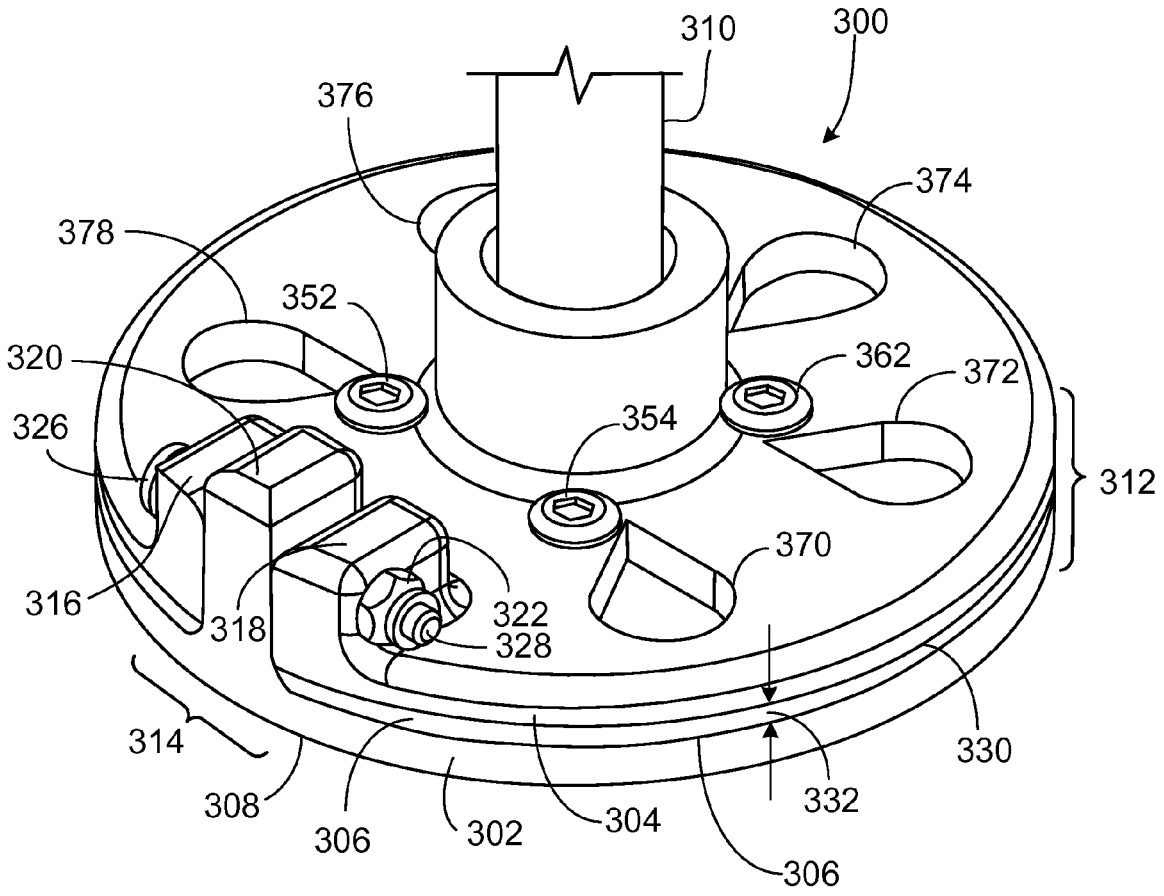
Figure 9:
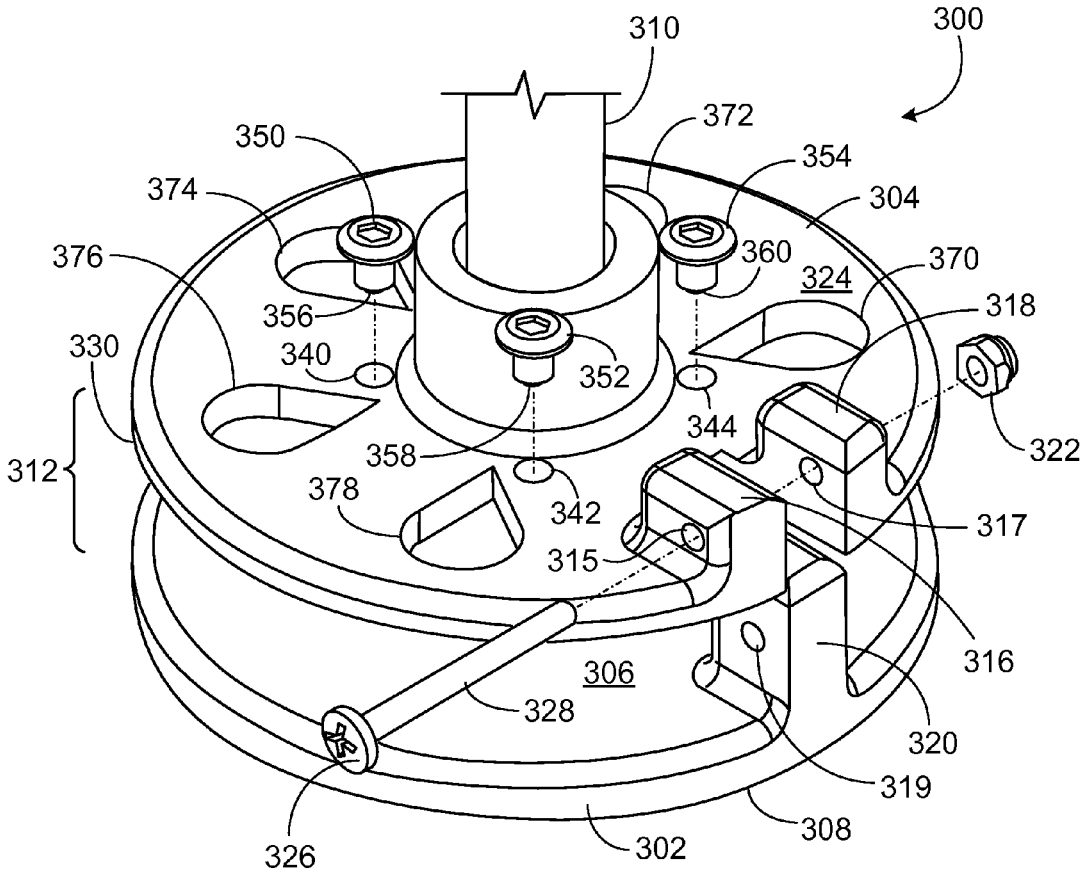
FIG. 9 is an exploded view of the example supporting device of FIGS. 8A and 8B.

Referring to FIGS. 8A, 8B, and 9, in some implementations, a supporting device 300 includes a convertible surface engaging device that has a two plate assembly 312 mounted on a pole 310. The pole 310 can be a lower portion of a supporting member, e.g., a crutch or a cane. The lower portion can either include or be without a surface engaging member (e.g., 105). The two plate assembly 312 can be permanently attached to the pole 310, or can be removed when necessary or desired. For example, the heads of screws 350, 352, 354 that go in holes 340, 342, 344 of the assembly 312 can lock into grooves of the bottom of the crutch to form a friction fit.

In either situation, during use of the supporting device 300, a surface of the supporting device 300 that contacts another surface, such as a floor or an outdoor region, is a surface of the plate assembly. The pole 310 or the bottom, if it exists, is not exposed and is fully covered from underneath by the plate assembly 312.

The plate assembly 312 includes a work plate 304 and a rotatable plate 302 secured together through a connection mechanism 314. The connection mechanism includes parts 316, 318 connected to and extending from an upper surface 324 of the work plate 304, and part 320 connected to and extending from an upper surface 306 of the rotatable plate 302. The parts 316, 318, 320 define holes 315, 317, 319, respectively, which can be aligned, and a pivot 328 that can extend through the aligned holes. The pivot 328 is secured at both ends using screw sets 322, 326. The connection mechanism 314 can act similarly to a hinge, such that the rotatable plate 302 and its connected part 320 can rotate relative to the work plate 304 and its connected parts 316, 318.

After the plate assembly 312 is mounted on the pole 310, the work plate 304 remains stationary relative to the pole 310, while the rotatable plate 302 can be moved between an exposing position shown in FIG. 8A and a covering position shown in FIG. 8B. In the exposing position, a lower surface 330 of the work plate 304 is exposed and if the supporting device 300 is used in this configuration, the exposed lower surface 330 contacts a surface, e.g., a floor or a land. In the covering position, the lower surface 330 of the work plate 304 is covered by the rotatable plate 306 and a lower surface 308 of the rotatable plate 306 is exposed to contact a surface to provide support to a user.

The connection mechanism 314 is constructed such that movement of the rotatable plate 302 requires a force greater than the gravity force on the plate 302. In other words, in either position shown in FIG. 8A or FIG. 8B, the rotatable plate 302 does not rotate automatically but remains at a fixed position until a force in addition to the gravity force is applied. The rotatable plate 302 can be moved between the two positions using the same or similar mechanisms described for moving the work plate 160 of FIGS. 5A and 5B.

The work plate 304 has features similar to those of the work plate 160. For example, the work plate 304 can have a relatively large surface area to contact another surface in order to provide stable support to a user. The upper and lower surfaces 324, 330 can have a round shape with a diameter of about 3 inches to 6 inches, e.g., 5 inches, although the surfaces can also have other shapes and/or sizes.

In some implementations, similar to the lower surface 163 of the work plate 160, the lower surface 330 of the work plate 304 also has screw tips that extend beyond the surface, and optionally roughened features and/or protrusions. In the example shown in the figures, the plate 304 includes a pattern of four screw holes 340, 342, 344 (one not shown) that extend through the thickness of the plate 304, although any number of screw holes can be used. Screws 350, 352, 354, 362 each fits a screw hole and each has an extended tip 356, 358, 360 (the tip of the screw 362 not shown) similar to the screws 200, 202, 204, 206 of FIG. 6. When the screws are fully screwed into respective screw holes, at least parts of the extended tips 356, 358, 360 extend beyond the lower surface 330 of the plate 304, e.g., by about 0.125 inch to about 0.5 inch, e.g., 0.25 inch. A side view of the plate 304 with the extended screw tips can be similar to the view shown in FIG. 7. In addition, the lower surface 330 may be roughened and/or may include protrusions.

Furthermore, the work plate 304 also includes a pattern of through holes, similar to the work plate 160 of FIG. 6. In the example shown in the figures, there are five through holes 370 to 378, although other numbers can also be used. The work plate 304 and the screws 350, 352, 354, 362 can be made of the same material(s) as the work plate 160 and the screws 200, 202, 204, 206, respectively.

The features of the work plate 304, including its large surface area, the extended screw tip parts beyond the lower surface 330, the possibly roughened lower surface 330, the possible protrusions on the lower surface 330, and the pattern of through holes in the plate, can provide similar or the same benefits to the supporting device 300 as those described for the features of the work plate 160. For example, if the supporting device 300 is used when the plate assembly 312 is in the exposing position, the work plate 304 can provide the supporting device 300 with stability when the exposed lower surface 330 is in contact with a slippery surface, such as ice, or a soft surface, such as sand or snow.

The shape and size of the rotatable plate 302 is chosen such that when the plate assembly 312 is in the covering position, the upper surface 306 covers the previously described features of the lower surface 330 of the work plate 304. In some implementations, the rotatable plate 302 has the same shape and size as the work plate 304. The rotatable plate 302 can also have a different shape and/or a larger size than the work plate 304. In some implementations, the part 320 of the connection mechanism 314 is sized such that when the plate assembly 312 is in the covering position shown in FIG. 8B, the upper surface 306 of the rotatable plate 302 does not contact the lower surface 330 of the plate 304 or the features extending beyond the lower surface 330. A distance 322 between the surfaces 306, 330 can be about 0.125 inch to about 0.375 inch, e.g., about 0.25 inch. The distance between the surfaces 306, 330 can protect the surface 306 from being damaged by the potentially sharp features extending beyond the surface 330 or of the surface 330. In some implementations, the upper surface 306 of the plate 302 is a soft surface, e.g., a soft rubber surface, so that even if the distance between the surfaces 306, 330 is relatively small, e.g., zero, the potentially sharp features of the plate 304 do not damage the surface 306.

In some examples, the rotatable plate 302 is a solid plate and the lower surface 308 is generally flat without patterns defined in the surface. The entire rotatable plate 302 can be made of the same material, such as rubber. In some implementations, the upper and lower surfaces 306, 308 of the plate 302 can be formed of different materials. For example, the upper surface 306 can be formed of aluminum or polycarbonate, and the lower surface 308 can be formed of polycarbonate. In some implementations, the plate 302 is formed, e.g., molded, using one material, e.g., polycarbonate. When the assembly 312 is in the covering position shown in FIG. 8B, the lower surface 308 of the plate 302 contacts another surface, such as a floor, to provide support for a user. The flat surface 308 is friendly to indoor floors, e.g., hardwood or ceramic floors.

In use, the supporting device 300 can be adjusted to be in the exposing position when the user is using the supporting device outdoor, e.g., on a slippery surface or on a soft surface. The supporting device 300 can be adjusted to the covering position when the user comes indoor to prevent the features of the work plate 304 from damaging the floors indoor.

Other embodiments are within the scope of the following claims. For example, the supporting member 103 or 101 can be specially configured to work with the convertible surface engaging device 102 such that the lower portion 104 and the base 106 form an integral part.

What is claimed is:

1. An apparatus comprising:

a base for a supporting device having a bottom surface, when exposed, the bottom surface of the supporting device being for contact with another surface to provide support for a user of the supporting device;

a rotatable portion coupled to the base and rotatable relative to the base, wherein the rotatable portion comprises a work plate comprising an upper surface and a lower surface, wherein the work plate defines through holes across a plate thickness between the upper surface and the lower surface, and one or more elements, a portion of which is exposed beyond the lower surface of the work plate; and a rotation mechanism connecting the base and the rotatable portion, the rotation mechanism comprising a locking mechanism providing a first bias force to hold the work plate in a first position and a second bias force to hold the work plate in a second position, wherein, when the work plate is in the first position, the bottom surface of the supporting device is exposed, and when the work plate is in the second position, the bottom surface of the supporting device is covered by the work plate, and the lower surface of the work plate is exposed to be in contact with the other surface to provide support for a user of the supporting device, wherein the work plate is rotatably coupled to the base through a first link member and a second link member, the first link member is rotatably coupled to a first portion of the base, and the second link member is rotatably coupled to a second portion of the base, wherein the through holes provide open spaces when the work plate is in the second position, and wherein the locking mechanism comprises a spring.

2. The apparatus of claim 1, wherein the lower surface of the work plate has a larger surface area than the bottom surface of the supporting device.

3. The apparatus of claim 2, wherein the lower surface of the work plate is round and has a diameter of about 3 inches to 7 inches.

4. The apparatus of claim 1, wherein the one or more elements comprise one or more screws.

5. The apparatus of claim 1, wherein the portion of the one or more elements exposed beyond the lower surface of the work plate is sharp so that in use, the portion exposed penetrates an opposed hard surface to provide stability.

6. The apparatus of claim 1, wherein the work plate comprises polycarbonate.

7. The apparatus of claim 1, wherein the upper and lower surfaces of the work plate define openings corresponding to the through holes, the openings occupying about 20% to about 45% of surface areas of the upper and lower surfaces.

8. The apparatus of claim 1, wherein the base defines a hollow center through which a portion of the supporting device passes when the base is mounted to the supporting device.

9. The apparatus of claim 1, wherein the lower surface of the work plate defines protrusions that extend from the lower surface of the work plate.

10. The apparatus of claim 1, wherein the lower surface of the work plate is roughened.

11. The apparatus of claim 1 in which the locking mechanism is configured to enable the user to move the work plate from the second position to the first position by pushing the work plate away from the bottom surface of the supporting device, causing the spring to change from a first length to a second length that is longer than the first length, and pushing the work plate sideways to swing the work plate to the first position, causing the spring to change from the second length to a third length that is shorter than the second length.

12. The apparatus of claim 1 in which when the work plate moves from the first position to the second position, the second link member rotates relative to the base, the spring changes from a first length to a second length that is longer than the first length and then changes from the second length to a third length that is shorter than the second length.

13. The apparatus of claim 1 in which the spring moves past a portion of the second link member that is rotatably coupled to the second portion of the base as the work plate moves from the first position to the second position.

14. The apparatus of claim 1 in which the work plate is coupled to a support member, the support member has a first portion that is rotatably coupled to the first link member and the support member has a second portion that is rotatably coupled to the second link member.

15. A supporting device comprising:

a pole;

a bottom surface in contact with another surface to provide support for a user of the supporting device;

a convertible mechanism comprising a base mounted on the pole;

a rotatable portion coupled to the base and rotatable relative to the base, wherein the rotatable portion comprises a work plate that comprises an upper surface and a lower surface, wherein the work plate defines through holes across a plate thickness between the upper surface and the lower surface, and one or more elements, a portion of which is exposed beyond the lower surface of the work plate; and a rotation mechanism connecting the base and the rotatable portion, the rotation mechanism comprising a locking mechanism to provide a first bias force holding the work plate in a first position and a second bias force holding the work plate in a second position, wherein, in the first position, the bottom surface is exposed, and in the second position, the bottom surface of the supporting device is covered by the work plate and the lower surface of the work plate is exposed for contact with the other surface to provide support for a user of the supporting device, wherein the through holes provide open spaces when the work plate is in the second position, wherein the work plate is rotatably coupled to the base through a first link member and a second link member, the first link member is rotatably coupled to a first portion of the base, and the second link member is rotatably coupled to a second portion of the base, and wherein the rotation mechanism comprises a spring, the spring has a first end that is coupled to the second link member, the spring has a second end that is coupled to a portion of the base, and the spring pulls the second link member towards the base.

16. The supporting device of claim 15, wherein the pole is part of a cane.

17. The supporting device of claim 16, wherein the pole is part of a crutch.

18. The supporting device of claim 16, wherein the pole is part of a walker.

19. The supporting device of claim 16, wherein the pole is part of a walking stick.

20. The supporting device of claim 15 in which when the work plate moves from the first position to the second position, the second link member rotates relative to the base, the spring changes from a first length to a second length that is longer than the first length and then changes from the second length to a third length that is shorter than the second length.

21. The supporting device of claim 15 in which the spring moves past a portion of the second link member that is rotatably coupled to the second portion of the base as the work plate moves from the first position to the second position.

22. An apparatus comprising:

a support device configured to provide support on a first surface, the support device comprising:

a support member that has a first surface engaging member;

a convertible surface engaging device coupled to the support member, the convertible surface engaging device having a second surface engaging member, the second surface engaging member being movable between a first position and a second position relative to the support member, in which when the second surface engaging member is in the first position, the second surface engaging member is positioned below the first surface engaging member, and when the second surface engaging member is in the second position, the second surface engaging member is positioned above the first surface engaging member;

a linkage mechanism having pivotable link members to enable the second surface engaging member to move between the first and second positions; and a bias mechanism to provide a first bias force to maintain the second surface engaging member in the first position after the second surface engaging member has moved to the first position, and to provide a second bias force to maintain the second surface engaging member in the second position after the second surface engaging member has moved to the second position, in which the bias mechanism comprises a spring that provides the first or second bias force, wherein when the second surface engaging member is in the first position, the second surface engaging member has a second surface that faces a first direction, and when the second surface engaging member is in the second position, the second surface of the second surface engaging member faces a second direction that is different from the first direction by at least 60 degrees and less than 120 degrees.

23. The apparatus of claim 22 in which the bias mechanism enables a user to move the second surface engaging member from the first position to the second position by applying a force greater than the first bias force, and to move the second surface engaging member from the second position to the first position by applying a force greater than the second bias force.

24. The apparatus of claim 22 in which the second surface engaging member has a larger surface area compared to the first surface engaging member.

25. The apparatus of claim 22 in which the first surface engaging member is configured for use when walking on a dry surface, and the second surface engaging member is configured for use when walking on at least one of a wet, a snowy, an icy, or a sandy surface.

26. The apparatus of claim 22 in which the first bias force is greater than the second bias force.

27. The apparatus of claim 22 in which the first surface engaging member comprises a rubber tip.

28. The apparatus of claim 22 in which the second surface engaging member comprises a disk.

29. The apparatus of claim 28 in which the second surface engaging member comprises projections extending downward from the disk when the second surface engaging member is in the first position.

30. The apparatus of claim 28 in which the disk comprises perforations.

31. The apparatus of claim 22 in which the support device extends along a longitudinal direction, and the first direction is substantially parallel to the longitudinal direction.

32. The apparatus of claim 22 in which the difference between the first and second directions is at least 80 degrees.

33. The apparatus of claim 22 in which the linkage mechanism comprises a first link member and a second link member, the first link member is rotatably coupled to the support member, the second link member is rotatably coupled to the first link member, and the second link member is secured to the second surface engaging member.

34. The apparatus of claim 22 in which the pivotable link members comprise a first link member that is rotatably coupled to a first portion of the support member, and a second link member that is rotatably coupled to a second portion of the support member.

35. The apparatus of claim 22 in which when the work plate moves from the second position to the first position, the spring changes from a first length to a second length that is longer than the first length, and then changes from the second length to a third length that is shorter than the second length.

36. The apparatus of claim 22 in which the bias mechanism comprises a spring, the spring has a first end that is coupled to one of the pivotable link members, the spring has a second end that is coupled to a portion of the base, and the spring pulls the pivotable link member towards the base.

37. The apparatus of claim 36 in which when the second surface engaging member plate moves from the first position to the second position, the pivotable link member rotates relative to the base, the spring changes from a first length to a second length that is longer than the first length and then changes from the second length to a third length that is shorter than the second length.

38. An apparatus comprising:

a support device configured to provide support on a first surface, the support device comprising:

a support member that has a first surface engaging member;

a convertible surface engaging device coupled to the support member, the convertible surface engaging device having a second surface engaging member, the second surface engaging member being movable between a first position and a second position relative to the support member, in which when the second surface engaging member is in the first position, the second surface engaging member is positioned below the first surface engaging member, and when the second surface engaging member is in the second position, the second surface engaging member is positioned above the first surface engaging member;

a linkage mechanism having pivotable link members to enable the second surface engaging member to move between the first and second positions; and a bias mechanism to provide a first bias force to maintain the second surface engaging member in the first position after the second surface engaging member has moved to the first position, and to provide a second bias force to maintain the second surface engaging member in the second position after the second surface engaging member has moved to the second position, in which the second bias force has a component that pulls the second surface engagement member upwards such that when the second surface engagement member is in the second position, a downward force needs to be applied to a portion of the second surface engagement member in order to move the second surface engagement member away from the second position, wherein when the second surface engaging member is in the first position, the second surface engaging member has a second surface that faces a first direction, and when the second surface engaging member is in the second position, the second surface of the second surface engaging member faces a second direction that is different from the first direction by at least 60 degrees and less than 120 degrees.

39. An apparatus comprising:

a base for a supporting device having a bottom surface, when exposed, the bottom surface of the supporting device being for contact with another surface to provide support for a user of the supporting device;

a rotatable portion coupled to the base and rotatable relative to the base, wherein the rotatable portion comprises a work plate comprising an upper surface and a lower surface, wherein the work plate defines through holes across a plate thickness between the upper surface and the lower surface, and one or more elements, a portion of which is exposed beyond the lower surface of the work plate; and a rotation mechanism connecting the base and the rotatable portion, the rotation mechanism comprising a locking mechanism providing a first bias force to hold the work plate in a first position and a second bias force to hold the work plate in a second position, wherein, when the work plate is in the first position, the bottom surface of the supporting device is exposed, and when the work plate is in the second position, the bottom surface of the supporting device is covered by the work plate, and the lower surface of the work plate is exposed to be in contact with the other surface to provide support for a user of the supporting device, wherein the work plate is rotatably coupled to the base through a first link member and a second link member, the first link member is rotatably coupled to a first portion of the base, and the second link member is rotatably coupled to a second portion of the base, wherein the through holes provide open spaces when the work plate is in the second position, and wherein the rotation mechanism comprises a spring, the spring has a first end that is coupled to the second link member, the spring has a second end that is coupled to a portion of the base, and the spring pulls the second link member towards the base.

40. An apparatus comprising:

a support device configured to provide support on a first surface, the support device comprising:

a support member that has a first surface engaging member;

a convertible surface engaging device coupled to the support member, the convertible surface engaging device having a second surface engaging member, the second surface engaging member being movable between a first position and a second position relative to the support member, in which when the second surface engaging member is in the first position, the second surface engaging member is positioned below the first surface engaging member, and when the second surface engaging member is in the second position, the second surface engaging member is positioned above the first surface engaging member;

a linkage mechanism having pivotable link members to enable the second surface engaging member to move between the first and second positions; and a bias mechanism to provide a first bias force to maintain the second surface engaging member in the first position after the second surface engaging member has moved to the first position, and to provide a second bias force to maintain the second surface engaging member in the second position after the second surface engaging member has moved to the second position, in which the bias mechanism comprises a spring, the spring has a first end that is coupled to one of the pivotable link members, the spring has a second end that is coupled to a portion of the base, and the spring pulls the pivotable link member towards the base, wherein when the second surface engaging member is in the first position, the second surface engaging member has a second surface that faces a first direction, and when the second surface engaging member is in the second position, the second surface of the second surface engaging member faces a second direction that is different from the first direction by at least 60 degrees and less than 120 degrees.

41. The apparatus of claim 40 in which when the second surface engaging member plate moves from the first position to the second position, the pivotable link member rotates relative to the base, the spring changes from a first length to a second length that is longer than the first length and then changes from the second length to a third length that is shorter than the second length.

* * * * *